US005195618A

United States Patent [19]

Wu

[11] Patent Number: 5,195,618

[45] Date of Patent: Mar. 23, 1993

[54] BRAKE ADJUSTER FOR A PEDALING TRAINING MACHINE OR EXERCISE BICYCLE

[76] Inventor: Mu C. Wu, No. 23, Hai Huan Street, Tainan, Taiwan

[21] Appl. No.: 850,527

[22] Filed: Mar. 13, 1992

[51] Int. Cl.[5] ..... B60L 7/28; A63B 23/04

[52] U.S. Cl. ..... 188/164; 482/63; 482/903

[58] Field of Search ..... 188/164, 165, 267; 310/77, 93, 95; 482/5, 63, 903

[56] References Cited

U.S. PATENT DOCUMENTS

| | | | |
|---|---|---|---|
| 3,860,235 | 1/1975 | DelMar | 482/63 |
| 5,031,900 | 7/1991 | Leask | 482/63 |
| 5,094,447 | 3/1992 | Wang | 482/63 |
| 5,145,480 | 9/1992 | Wang | 482/63 |

*Primary Examiner*—Robert J. Oberleitner

*Assistant Examiner*—Chus Schwartz

*Attorney, Agent, or Firm*—Pro-Techtor International

[57] ABSTRACT

A brake adjuster for a pedaling training machine comprises a base, a position plate and a U-shaped magnetic arm combined together. The position plate is combined on the base with a pivotal shaft to be tilted up at the front and tilted down at the rear and can recover its horizontal position by elasticity of a spring pinched between the position plate and the base. The U-shaped magnetic arm is combined on and moves together with the position plate, having two permanent magnets on both sides of an intermediate opening. An iron turning disc fixed on a shaft of a pedal in the pedaling training machine is positioned to have its circumferential edge and its two sides extending for a preset distance in the opening to face the permanent magnets so as to stop the turning disc by a hand brake controlling a main shaft combined with the base.

1 Claim, 2 Drawing Sheets

BRAKE ADJUSTER FOR A PEDALING TRAINING MACHINE OR EXERCISE BICYCLE

BACKGROUND OF THE INVENTION

A conventional pedaling training machine has a kind of brake adjuster which comprises a belt to be gradually tightened around a turning disc to obtain effect of stopping the machine. Another kind of brake adjuster comprises an iron turning disc interposed between two permanent magnets of different polarity and the dimension of the turning disc facing the permanent magnets is to be adjusted to obtain different extend of force for stopping the training machine.

The latter can reduce very much wear and tear of components because of no friction between them, but the permanent magnets can be pulled up by fast rotation of the turning iron disc, which is positioned at a constant location. And the permanent magnets are originally positioned to vertically cross the iron turning disc, but the iron turning disc is turning very fast, and magnetic pulling force generated by the permanent magnets can allow the magnets to be pulled up gradually by inertia of the turning disc to incline up against the disc so that the dimension of the magnets facing the disc gradually decreases. And the larger the pedaling force is, the more the magnets can be inclined up. Then the brake loses its stopping force in proportion to the bias angle of the magnets.

SUMMARY OF THE INVENTION

The brake adjuster for a pedaling training machine in the present invention comprises a base, a position plate combined on the base by means of a pivotal shaft, and a U-shaped magnetic arm combined firmly on the position plate to move together.

The base has a main shaft hole for a main shaft to extend therein firmly so that the base can move to tilt up together with the main shaft rotated by a hand brake fixed on a handle of the pedaling training machine.

The position plate has its rear portion always pushed up by a coiled spring provided to be pinched between the position plate and the base.

The U-shaped arm has two permanent magnets attached on both side walls of an intermediate opening to face both side surfaces of an iron turning disc inserting for a preset distance in the opening to receive magnetic force generated by the two permanent magnets so as to be stopped when the iron turning disc is rotating, by operating a hand brake controlling the main shaft to rotate in various ways to incline the base so that the dimension of the magnets facing the turning disc may be changed and the magnetic force to stop the turning disc can also be changed.

The spring can push the rear portion of the position plate and the U-shaped arm is pulled and tilted up by the turning disc in rotating condition, it can be pulled down to its original position by the spring pushing up the rear portion of the position plate, because the arm is firmly combined with the position plate. Then the magnetic force to pull and stop the turning disc can be kept at the same level.

An iron turning disc fixed on a shaft of a pedal in a pedaling training machine is positioned such that its circumferential edge and both sides extend for a preset distance in the opening in the magnetic arm.

DETAILED DESCRIPTION OF THE INVENTION

Figure 1:
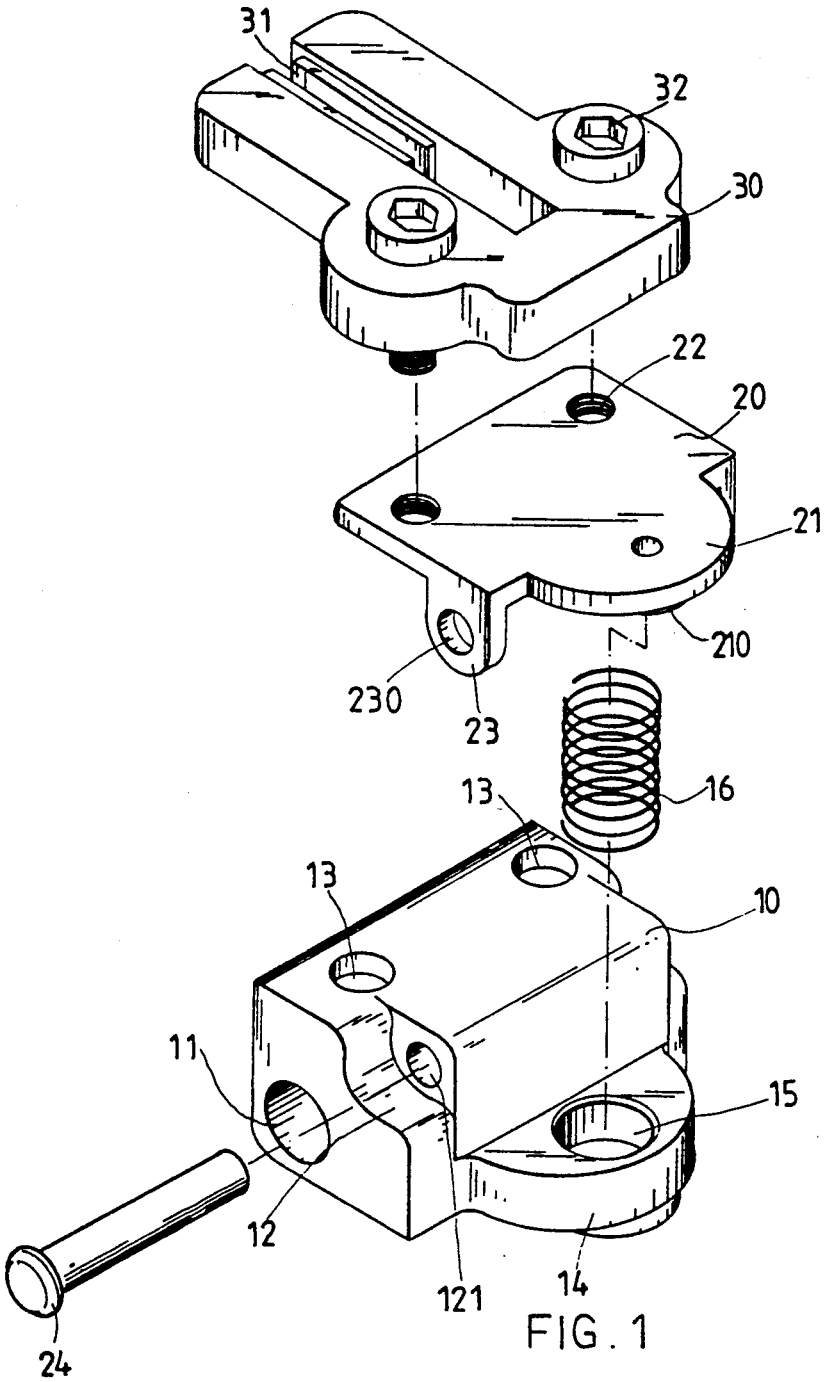
FIG. 1 is a cross-sectional view of the brake adjuster for a pedaling training machine in the present invention.

The brake adjuster for a pedaling training machine in the present invention, as shown in FIG. 1, comprises a base 10, a position plate 20 and an U-shaped magnetic arm 30 as its main components combined together.

The base 10 has a horizontal shaft hole 11 for a main shaft of a pedaling training machine to extend therein, a curved face 12 at the left side and a little backward above the shaft hole 11, two pivotal holes 121 for a pivotal shaft 24 to extend therein to combine the position plate 20 with the base 10, two round recesses 13 spaced apart in the upper surface near the front edge, a semicircular member 14 extending rearward from the lower portion of the rear side, and a large round cavity in the upper surface of the semi-circular member 14 for the lower end of a coiled spring 16 to sit therein.

The position plate 20 has a shape corresponding to the shape of the base 10, provided with a semi-circular portion 21 extending rearward, a downward projection 210 correspondingly facing down to the large cavity 15 in the semi-circular member 14 for the upper end of the spring 16 to fit around, two threaded holes 22 spaced apart to face toward the two round recesses 13 in the base 10, two pivotal members 23, 23, extending downward from both sides of the rear position, and a through hole 230 in each pivotal member for the pivotal shaft 24 to fit therein.

The magnetic arm 30 is a U-shaped, having a deep intermediate opening defining two parallel portions, two permanent magnets 31, 31 of different polarity attached on both side walls of the opening, in other words, on the inner sides of the two arms, and two holes spaced apart at both sides of the opening in the rear portion for two bolts 32 to pass through to screw with the threaded holes 22 in the position plate 20 and to fit in the two round recesses 13, 13 in the base 10.

Figure 2:
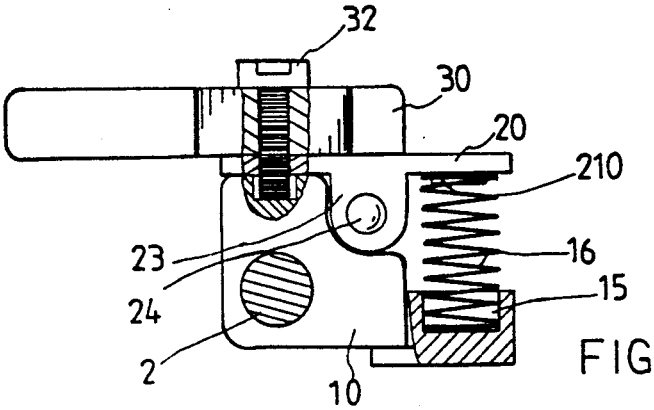
FIG. 2 is a side view of the brake adjuster for a pedaling training machine in the present invention.
Figure 3:
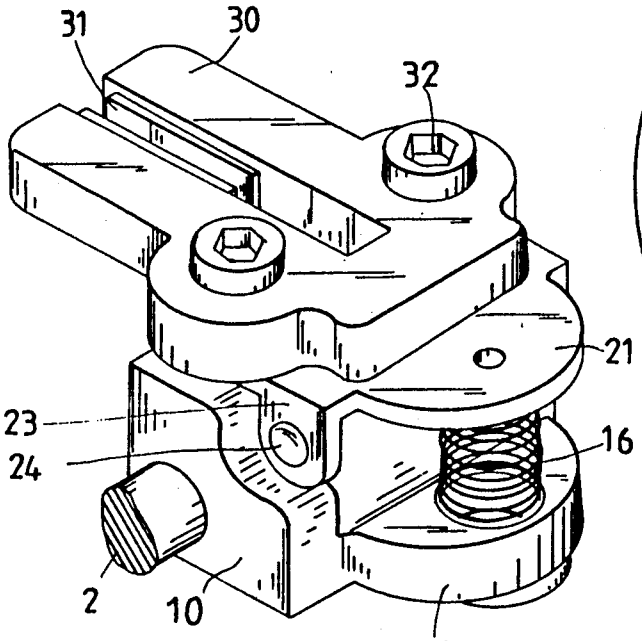
FIG. 3 is a perspective view of the brake adjuster for a pedaling training machine in the present invention.

In assembling this brake adjuster for a pedaling training machine, as shown in FIGS. 2 and 3, at first, the position plate 20 is to be combined with the magnetic arm 30, by inserting the screws 32 through the magnetic arm 30 and screwing them in the threaded holes 22 in the position plate 20. Next, the coiled spring 16 is to be interposed between the semi-circular member 14 in the base 10 and the semi-circular portion 21 in the position plate 20, stabilized with its upper portion fitting around the projection 210 and the lower portion sitting in the large round cavity 15. Then the base 10 and the position plate 20 are combined together by fitting the pivotal shaft 24 in the through hole 230 in the pivotal members 23, 23 in the position plate 20 and the through hole 121 in the base 10. And lastly, the main shaft 2 is to be fitted firmly in the shaft hole 11 in the base 10, then this adjuster can be finished by assembling it with the frame 1 of the pedaling training machine.

Figure 4:
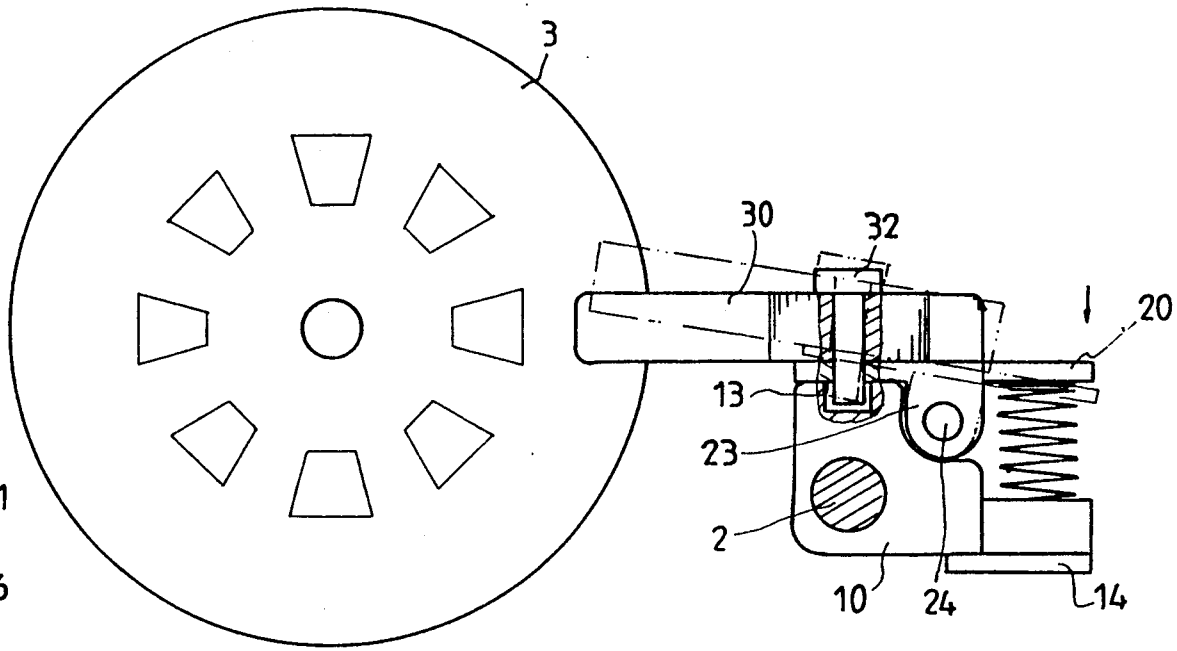
FIG. 4 is an actional view of the brake adjuster for a pedaling training machine in the present invention.

Referring to FIG. 4, how this brake adjuster works is to be described. The turning disc 3 is positioned with its circumferential edge interposed between the magnets 31, 31. The main shaft 2 firmly fixed in the shaft hole 11 can be rotated for an angle to rotate the base 10 for the same angle so that the dimension of the turning disc 3 facing the two magnets 31, 31 can be adjusted, and thus different extent of braking force to stop the turning disc can be obtained. When the turning disc 3 is rotated very fast by pedaling of a user of a pedaling training machine, it has an inertia force to pass across the magnet pulling force induced by the permanent magnets 31, 31 provided in the magnetic arm 30 so that the magnetic arm 30 can be pulled up at the front portion as shown by a dotted line in FIG. 4. But the magnetic arm 30 is combined firmly together with the position plate 20 which has its semi-circular rear portion always pushed upward by the spring 16, forcing the front portion of the position plate 20 and of the magnetic arm 30 to recover their original position, or the horizontal position from the inclined-up position pulled up by the turning disc 3 rotating. So the resisting force of the permanent magnets 31, 31 against rotation of the turning disc 3 can incessantly be kept at a preset value, because the dimension of the permanent magnets 31, 31 facing the side surfaces of the turning disc 3 is kept constant owing to horizontal intercrossing of the magnetic arm 30 on the turning disc 3.

I claim:

1. A brake adjuster for a pedaling training machine comprising:

a base having a main shaft hole for a main shaft of the pedaling training machine to firmly fit therein so as to rotate together with the main shaft and a round cavity in the rear portion for the lower end of a coiled spring to sit therein;

a position plate pivotally combined on the upper surface of said base, having a downward projection extending from a semi-circular rear portion in a corresponding location to the round cavity in the base for the upper end of the coiled spring to fit around the projection to position the coiled spring elastically stabilized between the base and the position plate;

a U-shaped magnetic arm being positioned on and fixed together with the position plate, having a straight intermediate opening and two permanent magnets respectively attached on two side walls defining the intermediate opening, and said two permanent magnets in said magnetic arm being located to cross part of both side surfaces of a turning disc in the pedal training machine; and said spring having elasticity to push up the rear portion of said position plate so as to force down the front portion of said position plate and said magnetic arm fixed together with said position plate when said magnetic arm is pulled up by the turning disc crossing said two permanent magnets, and said magnetic arm being kept horizontal by said spring so as to have a preset dimension to cross said surfaces of the turning disc.

* * * * *